US006895728B2

(12) United States Patent
Kondo

(10) Patent No.: US 6,895,728 B2
(45) Date of Patent: May 24, 2005

(54) FILM PACKAGING METHOD AND FILM PACKAGING DEVICE

(75) Inventor: Hideaki Kondo, Tokyo (JP)

(73) Assignee: Teraoka Seiko Co., Ltd., Tokyo (JP)

( * ) Notice: Subject to any disclaimer, the term of this patent is extended or adjusted under 35 U.S.C. 154(b) by 0 days.

(21) Appl. No.: 10/419,748

(22) Filed: Apr. 22, 2003

(65) Prior Publication Data

US 2003/0196415 A1 Oct. 23, 2003

(30) Foreign Application Priority Data

Apr. 23, 2002 (JP) ..... 2002-120945

(51) Int. Cl.[7] ..... B65B 53/00
(52) U.S. Cl. ..... 53/441; 53/466; 53/556
(58) Field of Search ..... 53/441, 461, 466, 53/509, 556, 209, 218

(56) References Cited

U.S. PATENT DOCUMENTS

| | | | | |
|---|---|---|---|---|
| 3,777,452 A | * | 12/1973 | Koenders | 53/556 |
| 3,967,433 A | * | 7/1976 | Bonfiglioli | 53/441 |
| 4,144,697 A | * | 3/1979 | Suga | 53/556 |
| 4,388,796 A | * | 6/1983 | Zelnick | 53/441 |
| 4,583,348 A | * | 4/1986 | Treiber et al. | 53/441 |
| 4,709,531 A | | 12/1987 | Denda | |
| 4,827,694 A | * | 5/1989 | Owen et al. | 53/441 |
| 4,862,670 A | | 9/1989 | Denda | |
| 4,936,080 A | * | 6/1990 | Haloila | 53/556 |
| 4,944,135 A | * | 7/1990 | Treiber | 53/556 |
| 5,259,170 A | * | 11/1993 | Tolson | 53/441 |
| 5,383,326 A | * | 1/1995 | Dean et al. | 53/556 |
| 5,473,861 A | | 12/1995 | Fukunaga et al. | |
| 5,603,198 A | * | 2/1997 | Rimondi et al. | 53/441 |
| 6,189,302 B1 | * | 2/2001 | Kudo et al. | 53/556 |
| 6,658,820 B2 | * | 12/2003 | Whitby et al. | 53/441 |

FOREIGN PATENT DOCUMENTS

JP 6-80111 3/1994

OTHER PUBLICATIONS

English Language Abstract of JP 6–80111.

* cited by examiner

*Primary Examiner*—Louis Huynh
(74) *Attorney, Agent, or Firm*—Greenblum & Bernstein, P.L.C.

(57) ABSTRACT

The purpose of this invention is to provide a packaging method and a packaging device in which a loading work and an unloading work for a packaged item performed by an operator can be reduced, a longitudinal length of the device can be made short and it can be manufactured in less-expensive manner. There is provided a packaging method for packaging a packaged item with a use of stretch film comprising the steps of: mounting the packaged item on a mounting table placed at a predetermined position; positioning an upper end of the packaged item below a position lower than a packaging segment for tensioning and holding the film used for a packaging operation after the packaged item is mounted on the mounting table; tensioning and holding the film on the packaging segment; moving the tensioned and held film and the mounting table having the packaged item mounted thereon in a relative manner and packaging the upper surface of the packaged item with the film; and folding the end part of the film packaging the upper surface of the packaged item below the packaged item.

6 Claims, 7 Drawing Sheets

FILM PACKAGING METHOD AND FILM PACKAGING DEVICE

BACKGROUND OF THE INVENTION

1. Field of the Invention

This invention relates to a packaging method and a packaging device in which some goods such as fresh foods or the like are packaged with a stretch film at a backyard of a super market and the like.

2. Description of the Related Arts

A stretch film packaging machine normally used in a supermarket and the like at present is constructed such that a goods mounting table (some type of packaging device are provided with a metering table) 35 is arranged at a slight lower position at an operator's side against the machine frame 34 constituting the packaging machine as shown in FIG. 11. When an operator puts the packaged item (goods) on the goods mounting table, the packaged item is loaded onto the elevator 37 positioned at the descending position by an in-feed conveyor 36 having a pusher. After loading operation, the elevator is lifted up, the packaged item is pushed up toward the film 39 tensioned and held at the packaging segment 38 above the elevator. The upper surface of the packaged item is packaged with the film, the end part of the film is folded toward the bottom surface of the packaged item to complete the packaging and the packaged item is unloaded to the discharging segment (or the heat seal segment) 40 arranged at the upper part of the device.

SUMMARY OF THE INVENTION

Accordingly, since the upper surface of the packaged item is covered by a film stretched and tensioned, a superior outer appearance packaging finish is attained.

However, in turn, the prior art had a problem that an operator has a large amount of operation accompanied by the aforesaid work because a height position where the packaged item is loaded into the device is different from the height position where the packaged item is unloaded from the device, resulting in that the operator is easily fatigued and a person operating the device for the first time erroneously performs the loading operation and the unloading operation.

In the prior art, a forward or rearward length of the packaging device was elongated because an in-feed conveyor is used and it led an increased cost of the entire device.

This invention has been invented in view of the problem found in the aforesaid prior art, and it is an object of this invention to provide a packaging method and a packaging device in which an operator can reduce a loading operation and an unloading operation for the packaged item, make a forward or rearward length of the device short and the device can be manufactured in a less-expensive manner.

A film packaging method of the present invention for accomplishing the aforesaid object is a packaging method for packaging the packaged item under application of a stretch film comprising the steps of: (a) mounting the packaged item on a mounting table kept at a predetermined position; (b) positioning the upper end of the packaged item at a lower position from the packaging segment for tensioning and holding the film used for packaging after the packaged item is mounted on the mounting table; (c) tensioning the film at the packaging segment; (d) moving the tensioned and applied film or the mounting table having the packaged item mounted thereon so as to package the upper surface of the packaged item with the film; and (e) folding the end part of the film packaging the upper surface of the packaged item down into the packaged item.

By the method described above, a loaded height position of the packaged item in respect to the packaging device is set to the same as the unloaded height position after completion of the packaging.

In the aforesaid method, when the mounting table where the packaged item is mounted is an elevator, this is comprised of the steps of: (a) mounting the packaged item on an elevator at its ascending position; (b) descending the elevator and positioning the upper end of the packaged item at a lower position from the packaging segment; (c) tensioning and applying the film at the packaging segment;(d) ascending the elevator, pushing up the upper surface of the packaged item toward the film tensioned and applied to the packaging segment and packaging the upper surface of the packaged item with the film; and (e) folding the end part of the film packaged the upper surface of the packaged item into the lower part of said packaged item.

When the mounting table where the packaged item is mounted is applied as a mounting table fixed at a predetermined position, it is comprised of the steps of: (a) mounting the packaged item on a mounting table; (b) tensioning and applying the film at the upper position of the packaged item by the film transferring device for transferring the film; (c) moving the film transferring device having the film tensioned and held toward the upper surface of the packaged item on the mounting table and packaging the upper surface of said packaged item with the film; and (d) folding the end part of the film packaged the upper surface of the packaged item into below said packaged item.

A film packaging device for performing the aforesaid packaging method is constructed such that the packaged item on an elevator is pushed up toward the film tensioned and applied to a packaging segment, the upper surface of the packaged item is packaged with the film, the end part of the film is folded into the bottom surface of the packaged item, and when the packaged item is mounted on the elevator, the elevator is positioned at a substantial upper limit position.

By the arrangement described above, it is possible to provide a packaging device in which a loading height position and an unloading height position of the packaged item are set to the same to each other.

After the packaged item is mounted at the elevator of the upper limit position, the elevator descends below the packaging segment, and descending of the elevator is applied under a condition in which the packaged item is detected by the item detecting sensor mounted at the packaging segment. Therefore, it is possible to prevent a useless descending operation when the packaged item is not present on the elevator.

Further, a starting position and a finishing position in one vertical cycle in the elevator are applied as substantial upper limit positions. Therefore, a high efficient packaging can be carried out.

The elevator is provided with a clearance passing in a vertical direction, a metering table is arranged at a lower position corresponding to the clearance, and when the elevator is positioned at the lower limit position, the packaged item on the elevator is supported on the metering table and its metering can be carried out. Therefore, it is possible to construct the packaging device having a metering function in a compact manner.

DESCRIPTION OF THE PREFERRED EMBODIMENTS

Figure 1:
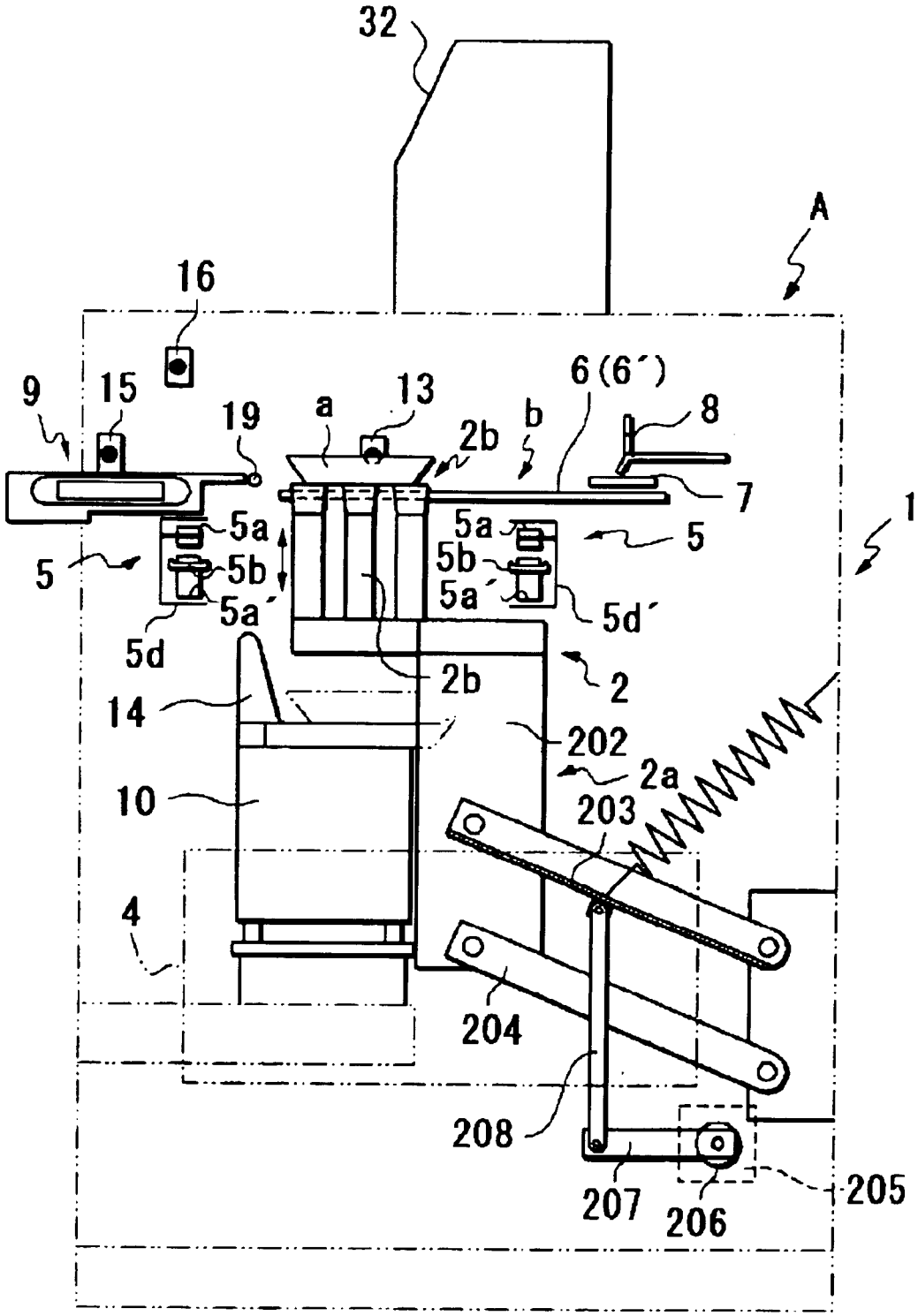
FIG. 1 is a longitudinal side elevation in section for showing one preferred embodiment of a packaging device of the present invention.

Referring now to the drawings, some preferred embodiments of the present invention will be described as follows.

FIG. 1 schematically shows a stretch film packaging device in which a mounting table having a packaged item mounted thereon is constituted by an elevator, wherein the packaging device A is constructed such that an elevator 2 having a packaged item (a) mounted thereon and moved up and down is arranged at a substantial central position in a machine frame 1 having a substantial parallel-piped shape, a packaging segment (b) for tensioning and holding a film used for a packaging operation is arranged at a lower position slightly lower than an upper limit position of the elevator 2, a roll arranging segment 3 for supplying a film for packaging the packaged item (a) is installed at a side part of the packaging segment (b), and a film roll 4 is set at the roll arranging segment 3.

In addition, a film transferring means 5 is arranged at a passage ranging from an upper position of the roll arranging segment 3 and passing over the packaging segment (b), both sides of a film 4' fed out of the film roll 4 by the film transferring means 5 are held, fed out by a predetermined length and cut and at the same time the cut film 4' is tensioned and mounted at the packaging segment (b).

Further, a left folding plate 6, a right folding plate 6' and a post-folding plate 7 are arranged over the transferring means 5 to fold the end part of the film 4' covering the upper surface of the packaged item (a) into a bottom surface side of the packaged item (a), a discharging pusher 8 is arranged over the post-folding plate 7 to enable the already-packaged packaged item a' to be pushed and discharged horizontally toward the heat seal segment 9. The front end of the film 4' is folded toward the bottom surface side of the packaged item (a) through pushing toward the heat seal segment 9, the end part of the folded film is heat sealed with the heat seal segment 9 to complete the packaging of it.

In addition, a metering table 10 is arranged at a lower position of the elevator 2. When the elevator having the packaged item (a) mounted thereon descends down to its lower limit position, the packaged item (a) is mounted on the metering table 10 to enable its weight to be measured.

The elevator 2 also acts a mounting table for mounting the packaged item (a), pushes up the packaged item (a) from below against the film 4' tensioned and arranged at the packaging segment (b) to package the upper surface of the packaged item (a) with the film 4'. The elevator 2 is comprised of an ascending or descending segment 2*a* and an elevator head 2*b*.The ascending or descending segment 2*a* is formed into a substantial gate-like shape by an upper plate 201 to which the elevator head 2*b* is fixed, and side plates 202, 202' fixed vertically toward a lower side at axial both ends of the upper plate 201 in its width direction. One end of a connecting plate 203 is fixed over the left side plate 202 and the right side plate 202'. The other end of the connecting plate 203 is connected to the machine frame 1. Links 204, 204' are positioned below the connecting plate 203 and fixed to the left side plate 202, right side plate 202' and the machine frame 1 so as to constitute the ascending or descending link mechanism.

Then, the ascending or descending segment 2*a* is operated such that a rotating operation provided by an electric motor 205 causes the ascending or descending segment 2*a* to be operated in an upward or downward direction through a rotating shaft 206, an operating lever 207 connected to the rotating shaft 206 and a vertical lever 208 connected to the operating lever 207, and then the ascending or descending segment 2*a* ascends or descends in a vertical direction within a specified range.

In addition, a starting position and a finishing position of the elevator 2 in one cycle of moving-up or moving-down operation are set at the upper limit position where the packaged item (a) is mounted, and the packaging operation is carried out.

In addition, the upper plate 201 of the ascending or descending segment 2*a* is constructed such that a clearance 11 passing through it in a vertical direction is formed like a comb as seen in its top plan view. The metering table 10 is arranged at a lower position corresponding to the upper plate 201. When the elevator 2 descends, the metering table 10 is fitted into and protrudes into the clearance 11 to support the packaged item (a) on the elevator 2 and then a weight of the packaged item (a) can be measured. Further, ascending of the elevator 2 is stopped until the elevator 2 descends to the lower limit position and a metering of the packaged item (a) performed by the metering table 10 is completed.

The elevator head 2*b* fixed to the upper surface of the upper plate 201 forming a comb-like shape is a well-known one normally used where the head member is fixed to the upper part of the rod lever in such a way that it can be raised or fallen, wherein a plurality of heads are raised and arranged with a predetermined space in a forward or rearward direction and a lateral direction.

Then, mounting of the packaged item (a) onto the elevator head 2*b* of the elevator 2 is carried out when the elevator 2 is positioned at the upper limit position and the elevator 2 descends when the packaged item (a) is mounted.

Descending of the elevator 2 is carried out after a presence or absence of the packaged item (a) on the elevator head 2*b* of the elevator 2 is detected.

Detection of whether or not the packaged item (a) is mounted on the elevator 2 positioned at the upper limit position is carried out by an item detecting sensor 13 arranged at the packaging segment (b) occupying the upper limit position of the elevator 2, and descending of the elevator 2 is started with the detecting signal of the item detecting sensor 13.

The film transferring means 5 holds both sides of an extremity end of the film fed out of the film roll 4 set at the roll arranging segment 3 arranged at the upstream side from the packaging segment (b), draws it out by a requisite length as required for packaging operation, cuts it, applies a tension to the film and holds it at the packaging segment (b)

The film transferring means 5 is constituted by a pair of upper and lower endless resilient belts 5*a*, 5*a*' for holding side ends of the film in its width direction; clamp plates 5*b* for pressing the lower resilient belts 5*a*' against the upper resilient belts 5*a*; and a depressing belt 5*c* arranged to overlap the upper surface at the starting end of the lower resilient belt 5*a*'. They are arranged at a forward side and a rearward side while holding the packaging segment (b).

Then, each of the pair of forward and rearward composing members is supported by the fixing frames 5*d*, 5*d*'. The fixing frames 5*d*, 5*d*' are properly spaced apart and fixed to the machine frame 1.

The pair of upper and lower endless resilient belts 5*a*, 5*a*' constituting the film transferring means 5 are driven and rotated in the same direction in such a way that the film can be held and transferred by them. The driving system is carried out such that a driving roller 5*f*' having the lower resilient belt 5*a*' wound around it is rotated by a motor 5*e* having a decelerator, the belt is wound around a pulley (not shown) fixed to the shaft of the driving roller 5*f*' and a pulley (not shown) fixed to the shaft of the driving roller 5*f* having the upper resilient belt 5*a* wound therearound so as to perform a transmission of the driving force and the upper resilient belt 5*a* is also rotated. Further, there is provided a tension adjusting mechanism in the midway part so as to perform a stable and positive holding and transferring of the film by the upper and lower resilient belts.

Figure 2:
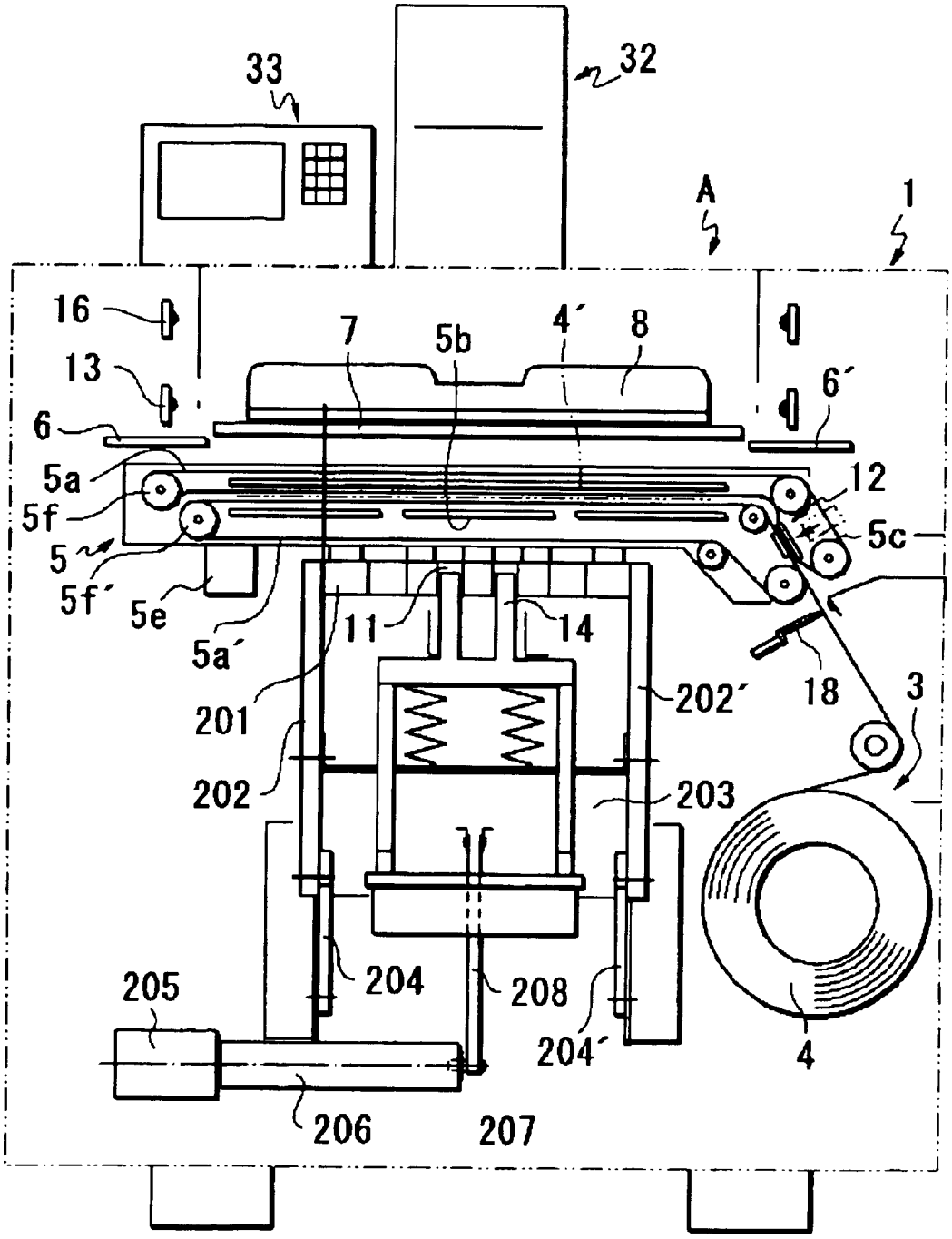
FIG. 2 is a longitudinal side elevation in section of FIG. 1.
Figure 3:
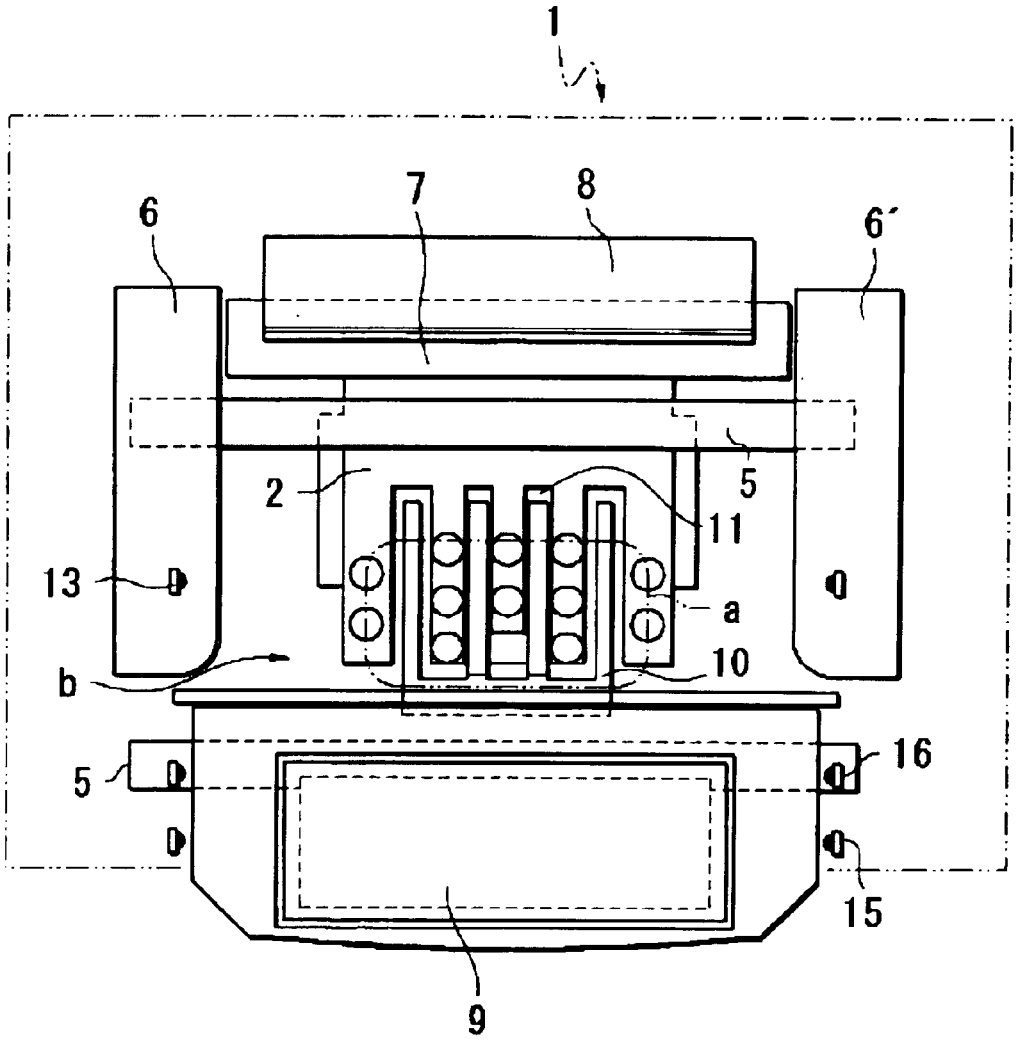
FIG. 3 is a cross sectional top plan view of FIG. 1.
Figure 4:
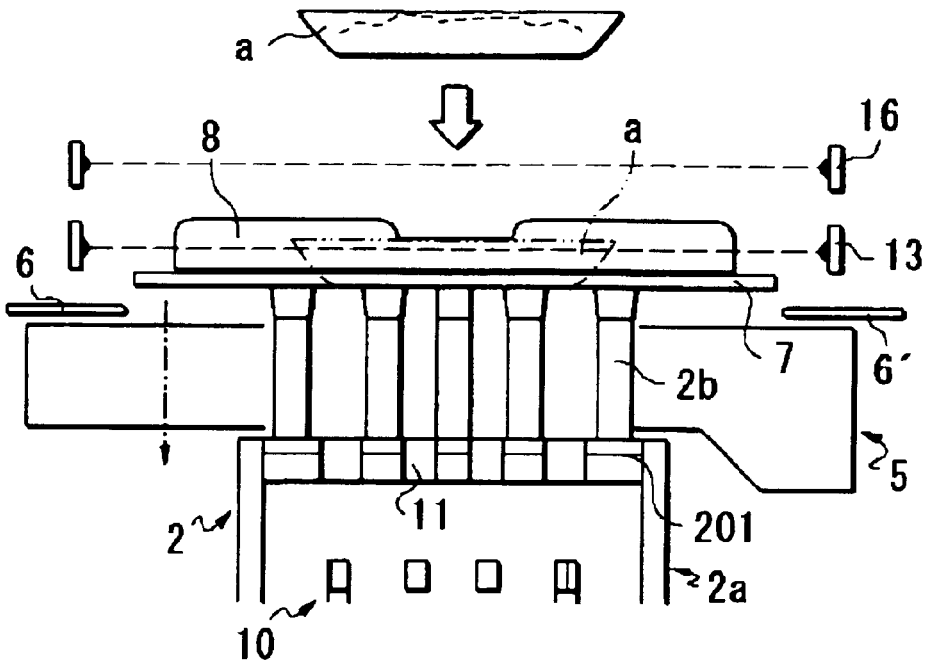
FIG. 4 is an illustrative view for showing a packaging stage of the packaging device and for showing a step for mounting a packaged item on an elevator.

In addition, the clamp plate 5*b* for depressing the lower resilient belt 5*a*' against the upper resilient belt 5*a* is divided into three segments as shown in FIG. 2, each of the three clamp plates is driven independently in a vertical direction by an electromagnetic solenoid and the like, pushed against the lower resilient belt 5*a*' and spaced apart from the lower resilient belt 5*a*'. Thus, a timing for releasing the three divided clamp plates 5*b* can be separately varied.

Further, a depress contacting segment 12 for depress contacting the extremity end of the film with the lower resilient belt 5*a*' and the pressing belt 5*c* and stopping a motion of the film is arranged at the starting end of the film transferring means 5. A perforation blade 18 for putting a perforation to cut the film fed out of the film roll 4 is arranged at an upstream side of the depress contacting segment 12 in such a way that it may be moved to or retracted from the film surface.

Hereby, the extremity end of the film passed through the depress contacting segment 12 mounted at the starting end of the film transferring means 5 and positioned at a downstream side is held under a driving of the transferring means, fed out by a predetermined length, the perforation blade 18 is operated at a position where the film is fed out by a predetermined length, a perforation is formed at the film 4, the film is transferred to a position where the perforation passes through the press contacting segment 12, the press contacting segment 12 is operated when the perforation passes through the press contacting segment 12 so as to stop motion of the film. Accordingly, the film positioned at the downstream side of the press contacting segment 12 is tensioned toward the downstream side through driving of the film transferring means 5, so that the film 4' of predetermined cut length is tensioned and held at the packaging segment (b).

A guide protrusion 14 having its inner surface inclined inwardly is raised and formed at a side edge where the already packaged item (a') is discharged as shown in FIG. 1 at the metering table 10 installed below the elevator 2. This guide protrusion 14 corrects a position of the packaged item (a) mounted on the elevator 2 so as to cause it to be mounted at a predetermined position of the metering table 10, upon completion of metering, and the packaged item (a) is positioned at a substantial central position of the packaging segment (b) when the packaged item is mounted again on the elevator 2 and pushed up against the film 4' tensioned and arranged at the packaging segment (b).

In addition, are moving sensor 15 for detecting a presence or a non-presence of the packaged item (a') of which packaging is completed is arranged at the heat seal segment 9, and a safety sensor 16 is arranged between the removing sensor 15 and the item detecting sensor 13 set at the packaging segment (b)

The safety sensor 16 is a sensor for use in detecting whether or not an operator's hand or the like is present near the heat seal segment 9 and in the case that it is confirmed that an operator's hand or the like is not present at least within a monitoring range of the safety sensor 16, a packaging cycle is started.

That is, in the case that the item detecting sensor 13 set at the packaging segment (b) detects a presence of the packaged item (a) in "ON" state and both the removing sensor 15 and the safety sensor 16 detect non-presence of the packaged item or non-presence of the operator's hand or the like in "OFF" state, the packaging can be started. As to the first instruction for inputting an item No. or the like is carried out under the aforesaid condition (the item detecting sensor 13: ON, the removing sensor 15: OFF, the safety sensor 16: OFF), the start key is operated to start the packaging operation and subsequently the packaging operation is started under the arrangement of the aforesaid condition.

In the drawings, reference numeral 32 denotes a label printer and reference numeral 33 denotes a console segment.

Then, referring to FIGS. 4 to 8, some packaging steps performed by the packaging device of the aforesaid first preferred embodiment will be described.

(1) At first, it is confirmed that the elevator 2 is positioned at the upper limit position, and the packaged item (a) is mounted on the elevator 2. Then, the fact that the packaged item (a) is mounted on the elevator 2 is detected by the item detecting sensor 13 (refer to FIG. 4).

Figure 5:
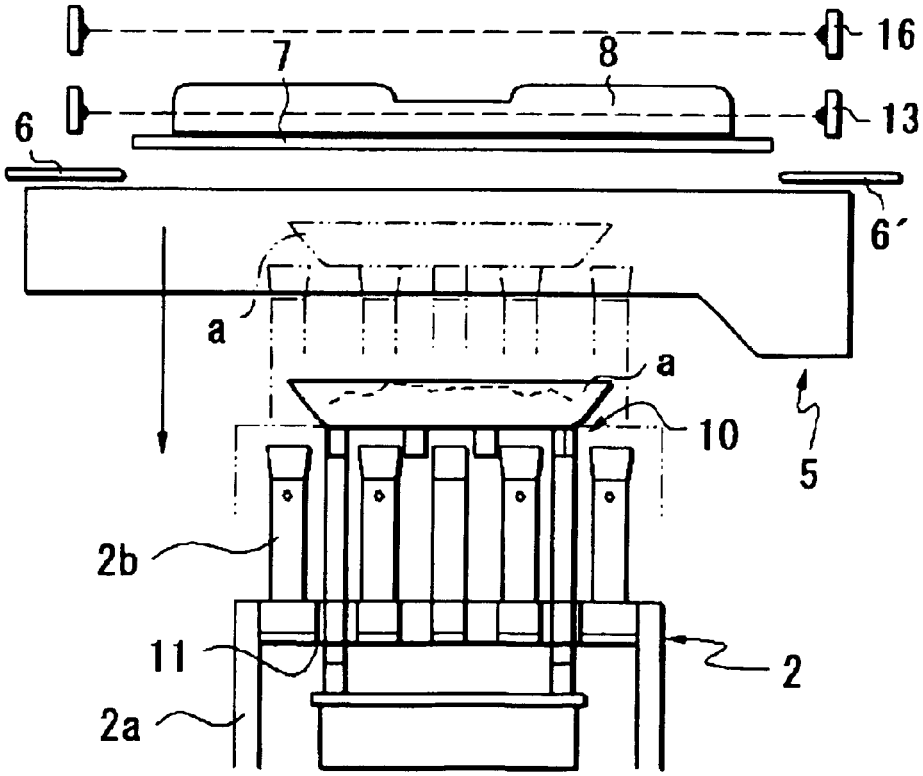
FIG. 5 is a view for showing a step in which an elevator having the packaged item mounted thereon descends.

(2) When the item detecting sensor 13 detects a presence of the packaged item (a), the elevator 2 starts descending operation and the upper end of the packaged item (a) mounted is moved to be positioned below the packaging segment (b) (refer to FIG. 5).

Figure 6:
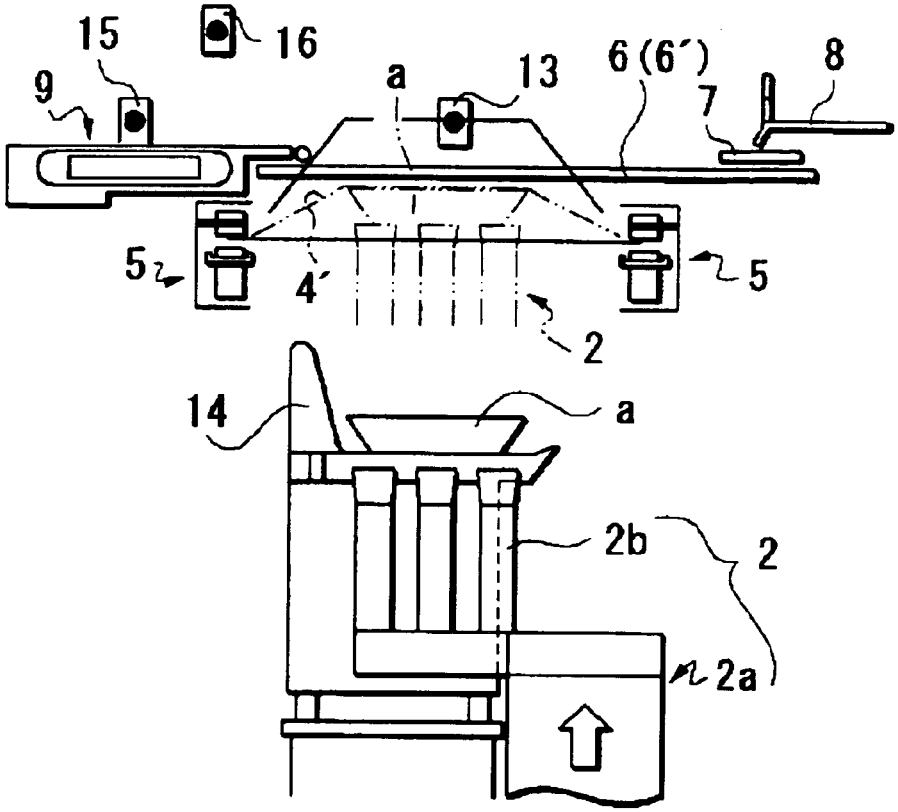
FIG. 6 is a view for showing a step in which the elevator is positioned at its lower limit position and a metering of the packaged item is carried out.
Figure 7:
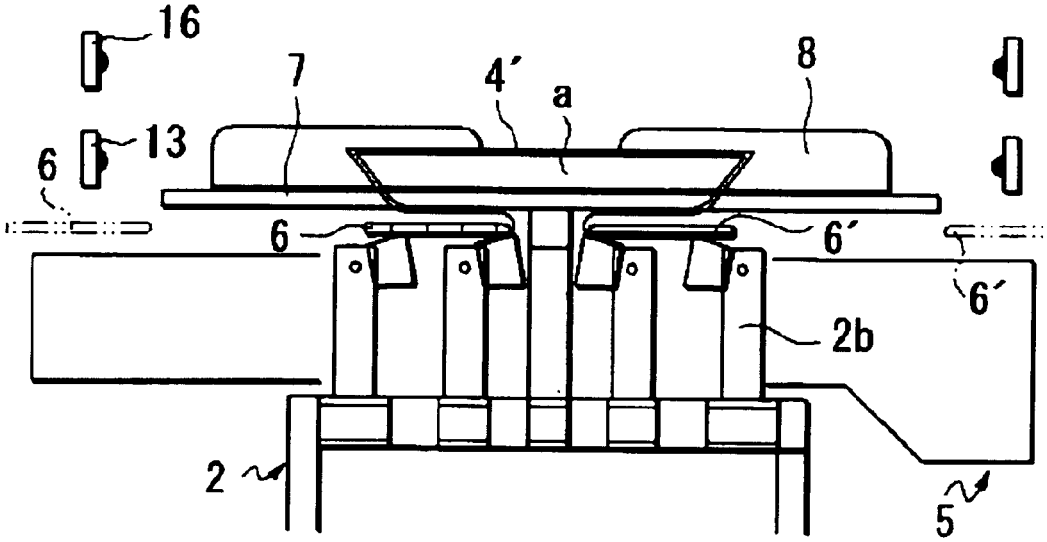
FIG. 7 is a view for showing a folded state of a film end.

(3) When the upper end of the packaged item (a) is positioned below the packaging segment (b), the film transferring means 5 is operated to draw out the film from the film roll 4 and at the same time the film 4' is cut at the perforation under an action of the press contacting segment 12 and the film 4' of predetermined length is tensioned and arranged at the packaging segment (b). Then, when the descending elevator 2 reaches the lower limit position, the metering table 10 is fitted into and protruded into the clearance of the upper plate 201 of comb-like shape of the elevator 2, the packaged item (a) supported on the elevator 2 is replaced onto the metering table 10 so as to meter a weight of the packaged item (a) (FIG. 6).

(4) Upon completion of metering of the packaged item by the metering table 10, the elevator 2 positioned at the lower limit position starts to ascend and the elevator 2 ascends again with the packaged item (a) mounted on the metering table 10. Then, the packaged item (a) is pushed up against the film 4' tensioned and arranged at the packaging segment (b) and the upper surface of the packaged item (a) is packaged with the film 4' (refer to two-dotted chain line in FIG. 6).

(5) Upon passing of the elevator 2 through the packaging segment (b), the left folding plate 6, right folding plate 6' are moved toward a center of the packaging segment (b) to fold the end part of the film 4' packaging the packaged item (a) into the bottom surface side of the packaged item (a). Folding of the end part of the film is carried out such that the elevator head mounting the packaged item (a) is fallen through motion of the left folding plate 6 and the right folding plate 6' (refer to FIG. 7).

Figure 8:
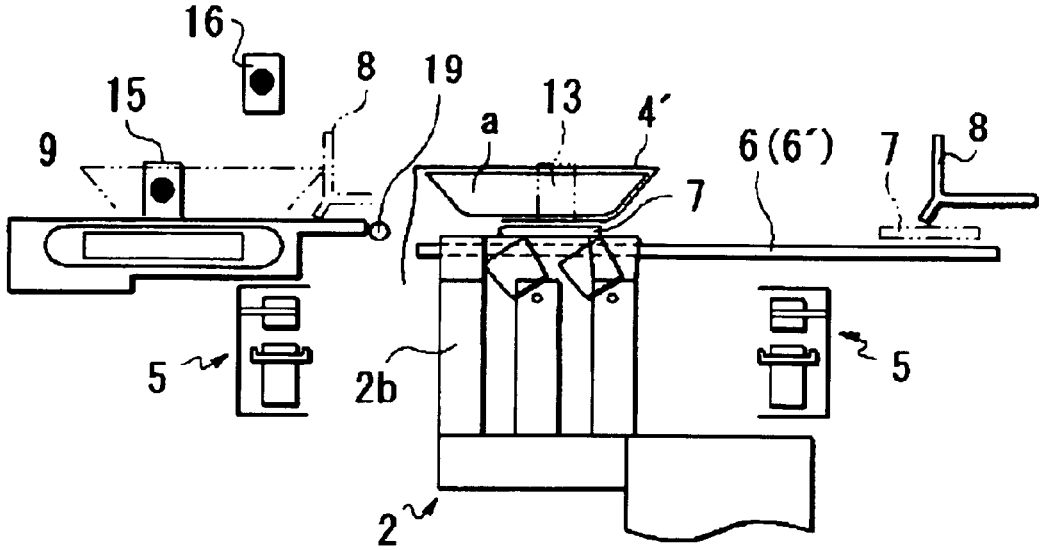
FIG. 8 is a view for showing a step from a post folding to a discharging.

(6) Subsequent to the folding of the film end part with the left folding plate 6 and the right folding plate 6', the post-folding plate 7 is operated to fold the rear film end into the bottom surface side of the packaged item (a) (refer to FIG. 8). Then, upon completion of the folding with the post-folding plate 7, the discharging pusher 8 is operated to push the packaged item (a) having the folding of the three film ends completed and discharge it toward the heat seal segment 9. At this time, the film end not yet folded passes over the pre-folding roller 19 arranged before the heat seal segment 9 and is folded into the bottom surface side, each of the overlapped film ends folded at the heat seal segment 9 is heat sealed (refer to FIG. 8). In the case that the packaged item (a') of which packaging is completed is removed from the heat seal segment 9, the removing sensor 15 detects non-presence of the packaged item and it is detected that the safety sensor 16 also detects that the operator's hand is not present near the heat seal segment, a subsequent step is started.

The aforesaid first preferred embodiment describes the elevator where the mounting table having the packaged item (a) mounted thereon ascends or descends. However, the mounting table of the present invention is not limited to the elevator and it is also applicable that a mounting table not ascending or descending is used. Some preferred embodiments (the second and third preferred embodiments) of the packaging device where the mounting table is fixed to a predetermined position (a height) will be described as follows.

Figure 9:
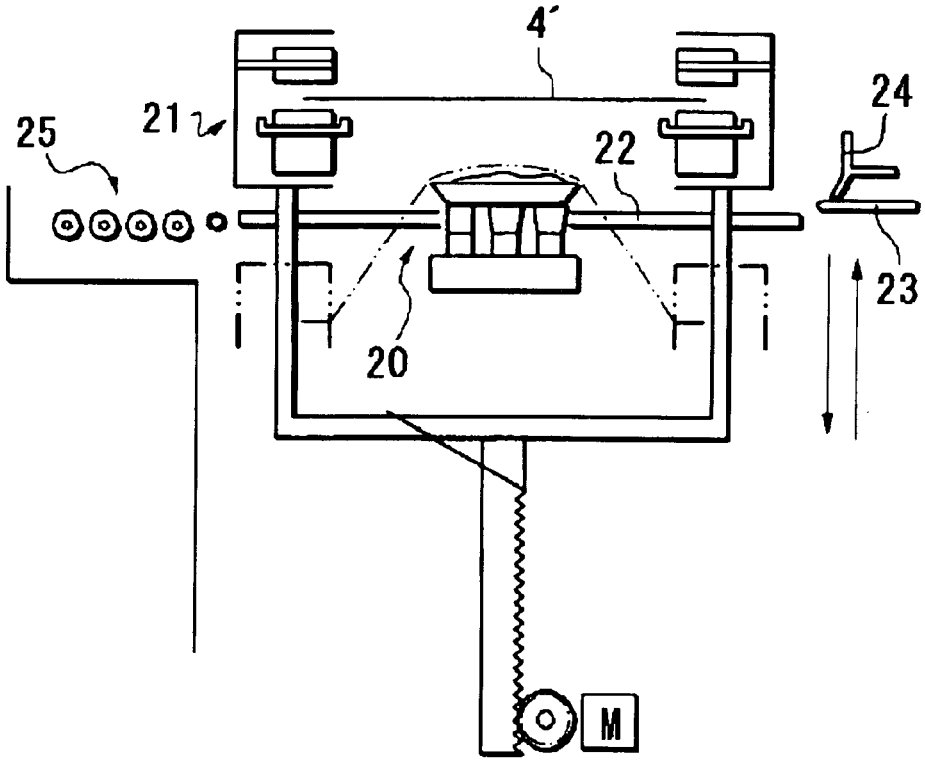
FIG. 9 is a schematic illustration for showing a preferred embodiment of a packaging device in which a mounting table having the packaged item mounted thereon is a fixed type.

FIG. 9 shows a second preferred embodiment, wherein the mounting table 20 not ascending or descending is fixed at a predetermined height position and the film transferring means 21 shown at the aforesaid preferred embodiment in regard to the mounting table 20 can be ascended or descended in a range from the upper position to the lower position by the mounting table 20. Then, the right and left folding plates 22, a post-folding plate 23, a discharging pusher 24 and a discharging segment (or the heat seal segment) 25 where the packaged item (a') having packaged state completed is discharged through the discharging pusher 24 are arranged on a horizontal line of the fixed mounting table 20.

As an ascending or descending mechanism for the film transferring means 21, a combination of a motor and a rack-and-pinion, for example, can be applied. Further, the mounting table 20 has the same constitution as that of the elevator head of the elevator in the aforesaid preferred embodiment.

The packaging device having the aforesaid configuration can perform a packaging operation through the following steps.

(1) When the film transferring means 21 is positioned above the mounting table 20, an operator mounts the packaged item (a) on the mounting table 20.

(2) The film transferring means 21 is operated to draw the film out of the film roll, cut it to a predetermined length and then the film is tensioned and applied at the packaging segment.

(3) The film transferring means 21 having the film tensioned and held therein descends below the mounting table 20 and then the upper surface of the packaged item (a) on the mounting table 20 is packaged with the film 4'.

(4) The right and left folding plates 22 and the post-folding plate 23 are operated to fold the film end toward the bottom surface of the packaged item (a).

(5) Lastly, the discharging pusher 24 pushes the film to perform a folding of the front side film end and discharges it to the discharging segment (the heat seal segment) 25.

Figure 10:
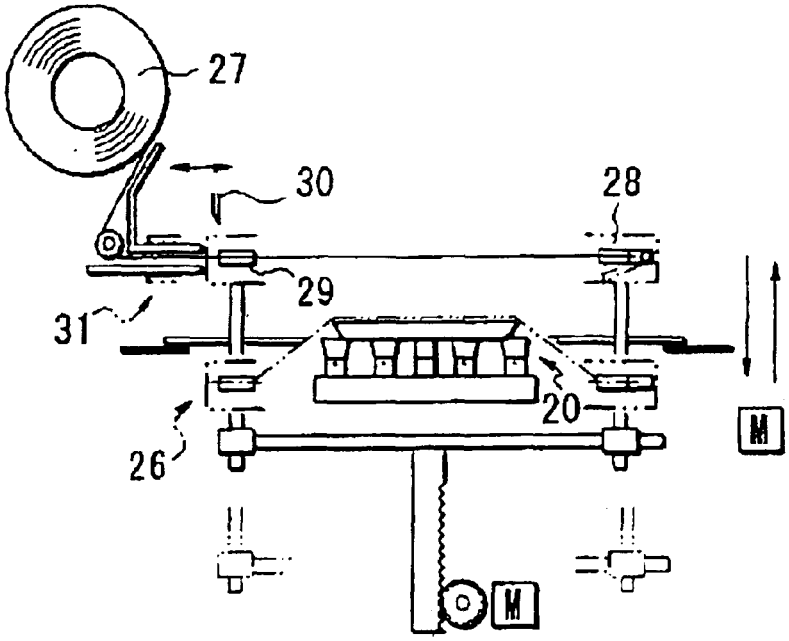
FIG. 10 is a schematic illustration for showing another preferred embodiment.
Figure 11:
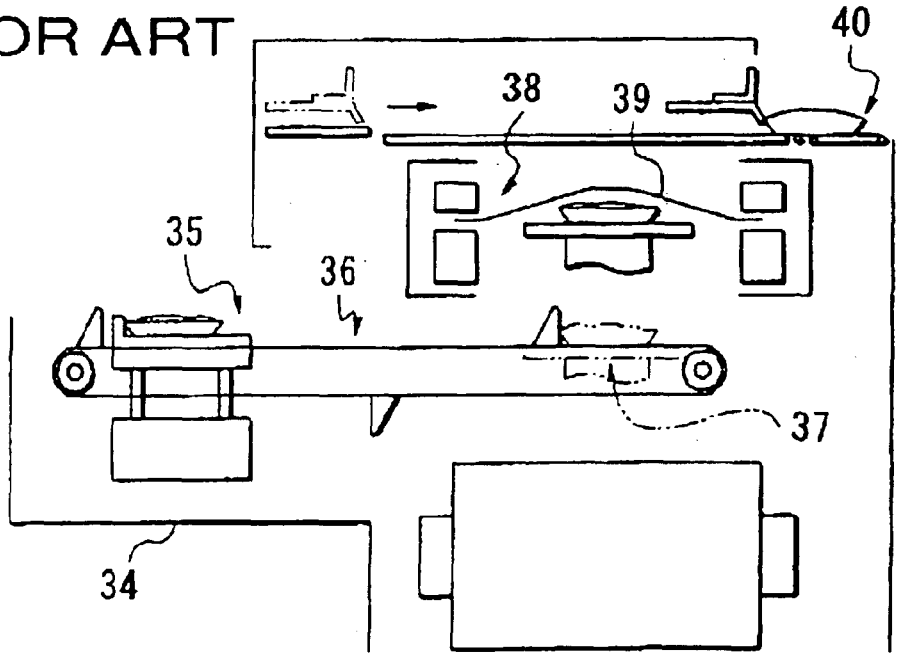
Fig. 11 PRIOR ART
FIG. 11 is a schematic illustration for showing the prior art packaging device.

FIG. 10 shows a third preferred embodiment, wherein the constitution of the film transferring means 21 in the aforesaid second preferred embodiment is changed from the holding and transferring by the belt to the film drawing-out type with a gripper.

The film transferring means 26 is constituted by a front side gripper 28 for holding the extremity end of the film fed out of the film roll 27 and drawing by a predetermined length; and a rear side gripper 29 for holding the rear end of the film fed out by the front side gripper 28. A cutter 30 for cutting the held film and a film holding member 31 for holding the extremity end of the cut film roll are arranged at the upstream side of the rear side gripper 29.

Then, the film transferring means 26 constituted as described above is constituted such that it can ascend or descend in a vertical direction in respect to the mounting table 20.

The packaging device having the aforesaid configuration can perform a packaging operation through the following steps.

(1) When the film transferring means 26 is positioned above the mounting table 20, an operator mounts the packaged item (a) on the mounting table 20.

(2) The film transferring means 26 is operated to draw the film out of the film roll, cut it to a predetermined length and then the film is tensioned and applied to the packaging segment (b) by the front side gripper 28 and the rear side gripper 29.

(3) The film transferring means 26 having the film tensioned and held therein descends below the mounting table 20 and then the upper surface of the packaged item (a) on the mounting table 20 is packaged with the film 4'.

(4) The right and left folding plates 22 and the post-folding plate 23 are operated to fold the film end toward the bottom surface of the packaged item (a).

(5) The discharging pusher pushes the film to perform a folding of the front side film end and discharges it.

The packaging method of the present invention is not limited to the aforesaid preferred embodiments and the present invention can be applied to the following packaging machine.

(6) There is provided a packaging machine which is not limited to one in which folding of the film end (front side end) opposing against the discharging side is carried out by a depressing action, the folding of the film end is folded with the front, rear, right and left folding plates, the packaged item is manually removed from above the packaging segment after folding operation.

(b) The mounting table applied in the second and third preferred embodiments can be replaced with a metering table.

The film packaging method of the present invention can provide a packaging method in which a height of loading position of the packaged item to the packaging device and a height of discharging position of the packaged item having its packaging completed can be set to the same value and an operator's work can be reduced. While this is a stretch packaging of well-finished state, it is possible to eliminate a loading means (an in-feed conveyor) for the packaged item, with the result that it is possible to constitute the small-sized film packaging device which can be manufactured in less-expensive manner.

Then, the present invention enables an automatic packaging including an automatic tensioning and applying of the film to be carried out even if the system does not move up or down the packaged item, and further enables the packaging method capable of being realized by a simple constitution to be provided.

In addition, the packaging device carrying out the aforesaid packaging method can provide a packaging device in which a height of loading position of the packaged item to the packaging device and a height of the discharging position of the packaged item having its packaging state completed can be set to a same value to each other and then the operator's work can be reduced. In addition, since there is not provided a loading means for the packaged item (an in-feed conveyor and the like) found in the prior art device, an entire size of the packaging device can be reduced and it can be manufactured in a less-expensive manner.

The present invention enables a useless descending operation of the elevator when the packaged item is not mounted to be prevented. Thus, a stable packaging work can be carried out.

The present invention enables an efficient packaging to be carried out.

Further, the present invention enables the packaging device having a metering and packaging function to be constituted in a small-size and easy manner. Further, replacement of the packaged item can be performed easily and positively.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope of the invention as defined by the appended claims.

What is claimed is:

1. A packaging method for packaging a packaged item with a stretch film comprising:

(a) positioning a mounting table at a predetermined first position and mounting the packaged item on said mounting table, said mounting table configured to be raisable and lowerable;

(b) after the packaged item has been mounted on said mounting table, lowering said mounting table, to position an upper end of the packaged item at said predetermined first position, positioning a film used for packaging in a packaging segment at a second position which is lower than said predetermined first position to tension and hold the film;

(c) tensioning the film at the packaging segment;

(d) raising said mounting table, pushing up the upper surface of the packaged item toward the film tensioned by the packaging segment, and packaging the upper surface of the packaged item with the film; and (e) folding an end part of the film packaging the upper surface of the packaged item onto a lower part of the packaged item.

2. A packaging method for packaging a packaged item with a stretch film comprising:

(a) mounting the packaged item on a mounting table fixed at a predetermined position;

(b) horizontally tensioning and applying the film to the upper surface of the packaged item by a film transferring device for transferring the film;

(c) vertically moving the film transferring device having the film tensioned and held toward the upper surface of the packaged item on the mounting table and packaging the upper surface of said packaged item with the film; and (d) folding the end part of the film packaging the upper surface of the packaged item underneath the packaged item.

3. A packaging device for packaging a packaged item with a stretch film comprising:

(a) a mounting table configured to be raisable and lowerable between an upper limit position and a lower limit position, and having a packaged item mounted thereon;

(b) a packaging segment arranged between the upper limit position and the lower limit position for tensioning and holding a film used for packaging the packaged item;

(c) a folding plate for folding an end part of the film covering an upper surface of the packaged item into a bottom surface side of the packaged item; and wherein, the packaging segment is arranged between the upper limit position and the lower limit position of the mounting table, the mounting table mounts thereon the packaged item in a way of positioning at upper limit of ascending and the upper end of the packaged item mounted on the mounting table is moved to a lower position below the packaging segment, after the moving, tensioning and applying the film at the packaging segment, the film packages the upper surface of the packaged item in a way of ascending the mounting table positioned at said lower position towards the packaging segment tensioning and holding the film, and folding the end part of the film at the bottom surface side of the packaged item by the folding plate.

4. The film packaging device according to claim 3, further comprising an item detecting sensor, wherein the mounting table starts to descend when the item detecting sensor mounted at the packaging segment senses a condition in which the packaged item is mounted on the mounting table positioned at an upper limit position.

5. The film packaging device according to claim 3, wherein said upper limit position is a starting position and a finishing position in one vertical cycle of a operation.

6. The film packaging device according to claim 3, further comprising a metering table positioned at the lower limit position of the mounting table for supporting and metering the packaged item when the mounting table is at the lower limit position.

* * * * *

UNITED STATES PATENT AND TRADEMARK OFFICE

CERTIFICATE OF CORRECTION

PATENT NO. : 6,895,728 B2
DATED : May 24, 2005
INVENTOR(S) : H. Kondo

It is certified that error appears in the above-identified patent and that said Letters Patent is hereby corrected as shown below:

Column 9,
Line 56, after "table" (second occurrence) delete ",".

Column 10,
Line 58, before "operation" insert -- packaging --.

Signed and Sealed this

Seventh Day of February, 2006

JON W. DUDAS
*Director of the United States Patent and Trademark Office*